US008528560B2

(12) United States Patent
Duffy

(10) Patent No.: US 8,528,560 B2
(45) Date of Patent: Sep. 10, 2013

(54) FILTERING FACE-PIECE RESPIRATOR HAVING PARALLEL LINE WELD PATTERN IN MASK BODY

(75) Inventor: Dean R. Duffy, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 275 days.

(21) Appl. No.: 12/907,147

(22) Filed: Oct. 19, 2010

(65) Prior Publication Data

US 2011/0094515 A1 Apr. 28, 2011

Related U.S. Application Data

(60) Provisional application No. 61/254,314, filed on Oct. 23, 2009.

(51) Int. Cl.
*A62B 7/10* (2006.01)

(52) U.S. Cl.
USPC ..... 128/206.19

(58) Field of Classification Search
None
See application file for complete search history.

(56) References Cited

U.S. PATENT DOCUMENTS

| | | | | |
|---|---|---|---|---|
| 4,419,994 | A | | 12/1983 | Hilton |
| 4,606,341 | A | | 8/1986 | Hubbard et al. |
| 4,807,619 | A | | 2/1989 | Dyrud et al. |
| D339,658 | S | | 9/1993 | Lahteenmaki et al. |
| D380,545 | S | | 7/1997 | Nozaki et al. |
| 5,656,368 | A | * | 8/1997 | Braun et al. ..... 428/141 |
| 5,701,893 | A | * | 12/1997 | Kern et al. ..... 128/206.24 |
| D416,323 | S | | 11/1999 | Henderson et al. |
| D416,324 | S | | 11/1999 | Nixon et al. |
| D443,927 | S | | 6/2001 | Chen et al. |
| 6,394,090 | B1 | | 5/2002 | Chen et al. |
| D464,726 | S | | 10/2002 | Wolfe |
| D477,075 | S | | 7/2003 | Schoelling |
| D506,254 | S | | 6/2005 | Carlucci et al. |
| D519,208 | S | | 4/2006 | Wolfe |
| 7,145,054 | B2 | | 12/2006 | Zander et al. |
| D607,560 | S | | 1/2010 | Bruzadin et al. |
| D607,997 | S | | 1/2010 | Noel et al. |
| D609,803 | S | | 2/2010 | Ungar |
| D626,219 | S | | 10/2010 | Rubio |
| 2004/0255946 | A1 | | 12/2004 | Gerson et al. |

FOREIGN PATENT DOCUMENTS

| | | |
|---|---|---|
| EM | 000447404-0002 | 12/2005 |
| RU | 2090225 | 9/1997 |
| RU | 2233190 | 7/2004 |
| WO | WO 00/48481 | 8/2000 |
| WO | WO 2006/019472 A1 | 2/2006 |

* cited by examiner

*Primary Examiner* — Loan Thanh
*Assistant Examiner* — Andrew S Lo
(74) *Attorney, Agent, or Firm* — Karl G. Hanson

(57) ABSTRACT

A respirator 10 that has a harness 14 and a mask body 12 that is joined to the harness 14. The mask body 12 includes a filtering structure 16 that may contain a plurality of layers of nonwoven fibrous material 58, 60, 62. The layers of nonwoven fibrous material 58, 60, 62 have a thickness A and are welded together by at least two parallel weld lines 34', 34" that are spaced at 0.5 to 6 times A. A mask body that uses parallel weld lines may exhibit better resistance to collapse and may be manufactured at faster speeds than similar structures which use single weld lines of comparable width.

16 Claims, 5 Drawing Sheets

FILTERING FACE-PIECE RESPIRATOR HAVING PARALLEL LINE WELD PATTERN IN MASK BODY

CROSS-REFERENCE TO RELATED APPLICATION

This application claims the benefit of U.S. Provisional Patent Application No. 61/254,314, filed Oct. 23, 2009.

The present invention pertains to a filtering face-piece respirator that has a weld pattern disposed on its mask body, which weld pattern includes two or more closely-spaced parallel weld lines.

BACKGROUND

Respirators are commonly worn over the breathing passages of a person for at least one of two common purposes: (1) to prevent impurities or contaminants from entering the wearer's breathing track; and (2) to protect other persons or things from being exposed to pathogens and other contaminants exhaled by the wearer. In the first situation, the respirator is worn in an environment where the air contains particles that are harmful to the wearer, for example, in an auto body shop. In the second situation, the respirator is worn in an environment where there is risk of contamination to other persons or things, for example, in an operating room or a clean room.

A variety of respirators have been designed to meet either (or both) of these purposes. Some respirators have been categorized as being "filtering face-pieces" because the mask body itself functions as the filtering mechanism. Unlike respirators that use rubber or elastomeric mask bodies in conjunction with attachable filter cartridges (see, e.g., U.S. Pat. RE 39,493 to Yuschak et al.) or insert-molded filter elements (see, e.g., U.S. Pat. No. 4,790,306 to Braun), filtering face-piece respirators are designed to have the filter media cover much of the whole mask body so that there is no need for installing or replacing a filter cartridge. Filtering face-piece respirators commonly come in one of two configurations: molded respirators and flat-fold respirators.

Molded filtering face piece respirators have regularly comprised non-woven webs of thermally-bonded fibers or open-work plastic meshes to furnish the mask body with its cup-shaped configuration. Molded respirators tend to maintain the same shape during both use and storage. Examples of patents that disclose molded, filtering, face-piece respirators include U.S. Pat. No. 7,131,442 to Kronzer et al, U.S. Pat. Nos. 6,923,182, 6,041,782 to Angadjivand et al., U.S. Pat. No. 4,850,347 to Skov, U.S. Pat. No. 4,807,619 to Dyrud et al., U.S. Pat. No. 4,536,440 to Berg, and Des. 285,374 to Huber et al. Flat-fold respirators—as their name implies—can be folded flat for shipping and storage. Examples of flat-fold respirators are shown in U.S. Pat. Nos. 6,568,392 and 6,484,722 to Bostock et al. and in U.S. Pat. No. 6,394,090 to Chen.

During use, filtering face-piece respirators should maintain their intended cup-shaped configuration. After being worn numerous times and being subjected to high quantities of moisture from a wearer's exhalations—in conjunction with having the mask body bump into other objects while being worn on a person's face—known masks can be susceptible to collapsing or having an indentation pressed into the shell. A collapsed mask may be uncomfortable to the wearer, particularly if the indentation touches the nose or face. The wearer can remove the indentation by displacing the mask from their face and pressing on the indentation from the mask interior. To preclude masks from collapsing during use, additional layers have been added to the mask body structure to improve its structural integrity. U.S. Pat. No. 6,923,182 to Angadjivand et al., for example, uses first and second adhesive layers between the filtration layer and first and second shaping layers to provide a crush-resistant molded filtering face mask. To preserve the structural integrity of a flat-fold respirator, U.S. Pat. No. 6,394,090 to Chen provides first and second lines of demarcation on the mask body to assist in preventing collapse during use. U.S. patent application Ser. No. 12/562,239 to Spoo et al. uses four enclosed weld patterns on four quadrants of the mask body to achieve a collapse resistant structure. In known filtering face-piece respirators that use weld lines to enhance mask body structural integrity, the weld lines used are "single" in their application—that is, there are not pairs or groupings of closely-spaced parallel lines that work in concert with each other.

SUMMARY OF THE INVENTION

The present invention provides a new filtering face-piece respirator construction that assists in preventing mask body collapse during use. The respirator of the present invention comprises a mask harness and a mask body where the mask body comprises a filtering structure that has a total thickness "A". The filtering structure also has two or more parallel weld lines disposed therein that are spaced 0.5 to 6 times A.

The present invention is directed to providing a filtering face-piece respirator that possesses crush resistant properties that minimize mask body deformation caused by extended use or rough handling. The use of closely-spaced parallel weld lines may create a beam effect that makes the respirator less likely to lose its structural integrity from particle loading and moisture build-up. Filtering face-piece respirators that are less likely to collapse during use present the benefit of improving wearer comfort and convenience. Further, there is less need for additional layers or heavier layers to provide collapse resistant qualities. The use of less media in the mask body can result in lower breathing resistance and reduced product cost. The inventors also have discovered that faster welding speeds may be achieved when using two parallel weld lines that together have the same width as a single weld line. Because less surface area is welded using two parallel lines, less welding energy is required to bond the nonwoven fibrous materials; there is accordingly less risk of delamination, and so line speeds can be increased. Further, "welding flash" also tends to be minimized through use of closely-spaced parallel weld lines. "Welding flash" is excess material that was previously molten but becomes solidified along the edge or end of a weld line Welding flash can create an agglomerated bead of material and a hole in the mask body. When making a wide single weld, more material is melted, which has to be displaced in a rotary welding process. This "molten weld front" can get trapped in a converging embossing pattern and deposit "weld flash" on the trailing edge of the welded pattern. Because welding speeds can be increased and because less welding flash is experienced, manufacturing costs may be further reduced when producing a respirator that has closely-spaced parallel weld lines.

GLOSSARY

The terms set forth below will have the meanings as defined:

"bisect(s)" means to divide into two generally equal parts;

"comprises (or comprising)" means its definition as is standard in patent terminology, being an open-ended term that is generally synonymous with "includes", "having", or "containing". Although "comprises", "includes", "having", and "containing" and variations thereof are commonly-used, open-ended terms, this invention also may be suitably described using narrower terms such as "consists essentially of", which is a semi open-ended term in that it excludes only those things or elements that would have a deleterious effect on the performance of the inventive respirator in serving its intended function;

"clean air" means a volume of atmospheric ambient air that has been filtered to remove contaminants;

"contaminants" means particles (including dusts, mists, and fumes) and/or other substances that generally may not be considered to be particles (e.g., organic vapors, et cetera) but which may be suspended in air;

"crosswise dimension" is the dimension that extends laterally across the respirator from side-to-side when the respirator is viewed from the front;

"cup-shaped configuration" means any vessel-type shape that is capable of adequately covering the nose and mouth of a person;

"exterior gas space" means the ambient atmospheric gas space into which exhaled gas enters after passing through and beyond the mask body and/or exhalation valve;

"filtering face-piece" means that the mask body itself is designed to filter air that passes through it; there are no separately identifiable filter cartridges or insert-molded filter elements attached to or molded into the mask body to achieve this purpose;

"filter" or "filtration layer" means a layer of air-permeable material, which layer is adapted for the primary purpose of removing contaminants (such as particles) from an air stream that passes through it;

"filtering structure" means a construction that includes a nonwoven fibrous filtration layer and optionally other nonwoven fibrous layer(s);

"first side" means an area of the mask body that is located on one side of a plane that bisects the mask body normal to the cross-wise dimension;

"harness" means a structure or combination of parts that assists in supporting the mask body on a wearer's face;

"integral" means being manufactured together at the same time; that is, being made together as one part and not two separately manufactured parts that are subsequently joined together;

"interior gas space" means the space between a mask body and a person's face;

"laterally" means extending away from a plane that bisects the mask body normal to the cross-wise dimension when the mask body is in a folded condition;

"line of demarcation" means a fold, seam, weld line, bond line, stitch line, hinge line, and/or any combination thereof;

"longitudinal axis" means a line that bisects the mask body normal to the cross-wise dimension;

"mask body" means an air-permeable structure that is designed to fit over the nose and mouth of a person and that helps define an interior gas space separated from an exterior gas space;

"nose clip" means a mechanical device (other than a nose foam), which device is adapted for use on a mask body to improve the seal at least around a wearer's nose;

"parallel" means generally of equal distance apart;

"perimeter" means the outer edge of the mask body, which outer edge would be disposed generally proximate to a wearer's face when the respirator is being donned by a person;

"pleat" means a portion that is designed to be or is folded back upon itself;

"polymeric" and "plastic" each mean a material that mainly includes one or more polymers and that may contain other ingredients as well;

"plurality" means two or more;

"respirator" means an air filtration device that is worn by a person to provide the wearer with clean air to breathe;

"rib" means a discernable elongated mass of nonwoven fibrous material;

"second side" means an area of the mask body that is located on one side of a plane that bisects the mask body normal to the cross-wise dimension (the second side being opposite the first side);

"snug fit" or "fit snugly" means that an essentially air-tight (or substantially leak-free) fit is provided (between the mask body and the wearer's face);

"tab" means a part that exhibits sufficient surface area for attachment of another component;

"transversely extending" means extending generally in the crosswise dimension;

"weld" or "welded" means to join together through at least the application of heat; and "weld line" means a weld that is continuous over a distance of at least 2 centimeters.

DETAILED DESCRIPTION OF PREFERRED EMBODIMENTS

In practicing the present invention, a filtering face-piece respirator is provided that has at least two closely-spaced parallel lines that are welded into the mask body. These weld lines may help improve collapse resistance, improve aesthetics, and speed respirator manufacture.

Figure 1:
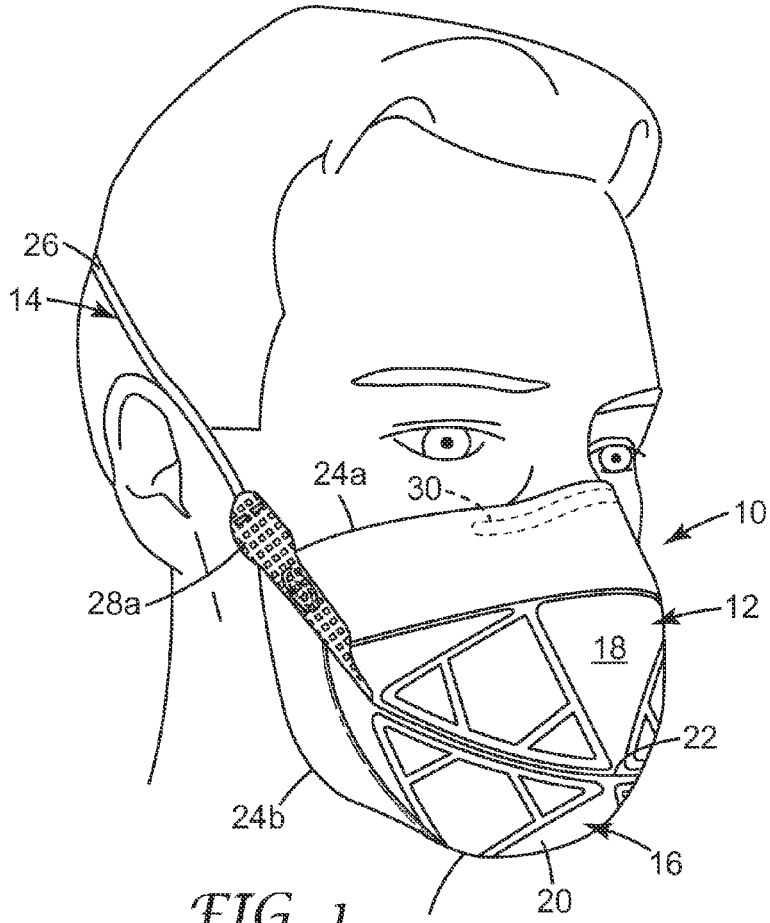
FIG. 1 is a perspective view of a filtering face-piece respirator 10 in accordance with the present invention.

FIG. 1 shows an example of a filtering face-piece respirator 10 in an opened condition on a wearer's face. The respirator 10 may be used to provide clean air for the wearer to breathe. As illustrated, the filtering face-piece respirator 10 includes a mask body 12 and a harness 14 where the mask body 12 has a filtering structure 16 through which inhaled air must pass before entering the wearer's respiratory system. The filtering structure 16 removes contaminants from the ambient environment so that the wearer breathes clean air. The mask body 12 includes a top portion 18 and a bottom portion 20. The top portion 18 and the bottom portion 20 are separated by a line of demarcation 22. In this particular embodiment, the line of demarcation 22 is an open pleat that extends transversely across the central portion of the mask body. The mask body 12 also includes a perimeter that includes an upper segment 24*a* and a lower segment 24*b*. The harness 14 has a strap 26 that is stapled to a tab 28*a*. A nose clip 30 may be placed on the mask body 12 on the top portion 18 on its outer surface or beneath a cover web.

Figure 2:
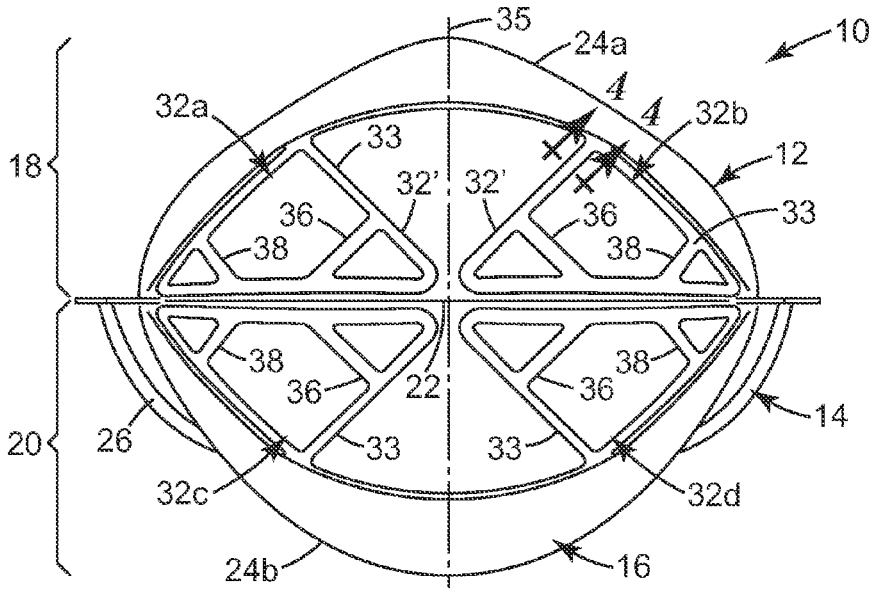
FIG. 2 is a front view of the filtering face-piece respirator 10 shown in FIG. 1.

FIG. 2 shows that the respirator 10 has first and second weld patterns 32*a*, 32*b*, disposed above and not traversing the line of demarcation 22. The first and second weld patterns 32*a*, 32*b* are located on each side of the longitudinal axis 35. The third and fourth weld patterns 32*c* and 32*d* are disposed below and not crossing the line of demarcation 22. The weld patterns 32*c* and 32*d* also are located on opposing sides of the longitudinal axis 35. Each of the first, second, third, and fourth weld patterns 32*a*, 32*b*, 32*c*, 32*d* contains weld lines 33 that define a two-dimensional enclosed pattern. Each weld pattern may exhibit a truss-type geometry that includes, for example, a larger triangle that has rounded corners and that has a pair of triangles 36 and 38 located within it. Each of the triangles 36, 38 is nested within the larger triangle 32*a*-32*d* such that the two sides of each of the triangles 36, 38 also forms a partial side of each of the triangles 32*a*-32*d*. The rounded corners typically have a minimum radius of about 0.5 millimeters (mm). As shown in FIG. 2, the weld patterns 32*a*-32*d* are provided on the mask body 12 such that there is symmetry on each side of the longitudinal axis 35 or on each side of the line of demarcation 22 and the longitudinal axis 35. Although the invention has been illustrated in the present drawings as being triangular patterns within a triangle, the two-dimensional enclosed patterns may take on other truss-type forms, including quadrilaterals that are, rectangular, trapezoidal, rhombusal, etc., which are welded into the mask body. Each two-dimensional enclosed weld pattern may occupy a surface area of about 5 to 30 square centimeters ($cm^2$), more commonly about 10 to 16 $cm^2$. The weld patterns also may take on other forms such as straight lines, curvilinear lines, and various concentric geometries. The lines may be configured to extend generally in the cross-wise dimension—see, for example, U.S. Pat. No. 6,394,090 to Chen.

Figure 3:
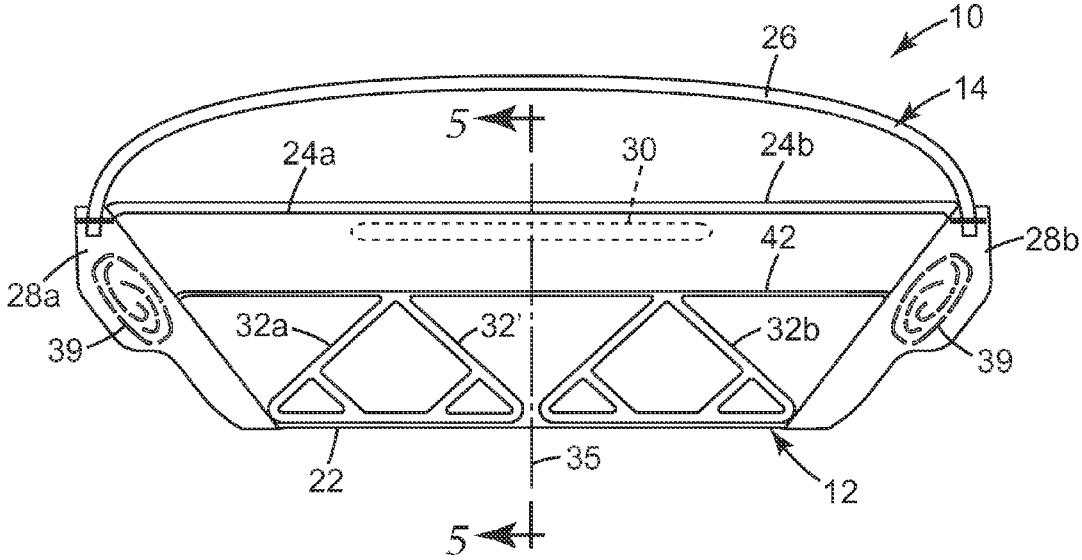
FIG. 3 is a top view of the filtering face-piece respirator 10 of FIG. 1 in a folded condition.

FIG. 3 shows a top view of the mask body 12 in a horizontally folded condition, which condition is particularly beneficial for shipping and off-the-face storage. The mask body 12 can be folded along the horizontal line of demarcation 22. The respirator may include one or more straps 26 that are attached to first and second tabs 28*a*, 28*b*, and indicia 39 may be placed on each tab 28*a*, 28*b* to provide an indication of where the wearer may grasp the mask body for donning, doffing, and adjusting. The indicia 39 that may be provided on each of the flanges is further described in U.S. patent application Ser. No. 12/562,273 entitled Filtering Face Piece Respirator Having Grasping Feature Indicator.

Figure 4:
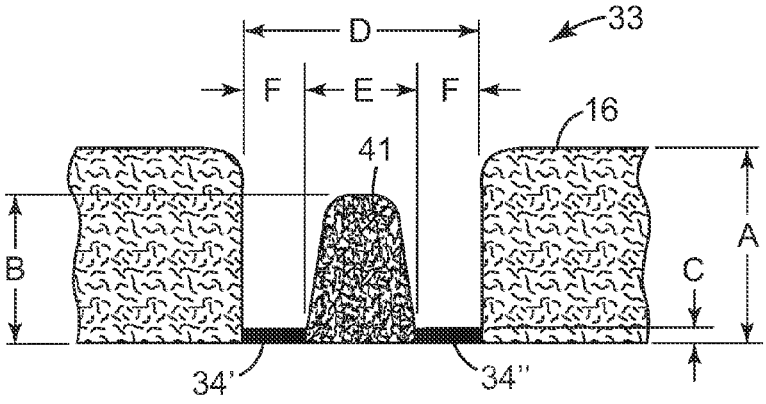
FIG. 4 is an enlarged cross-section of parallel weld lines 34' and 34" in a weld pattern 32*b*, taken along lines 4-4 of FIG. 2.

FIG. 4 shows a cross-section of dual weld line 33 in the weld pattern 32*b*. The dual weld lines 33 run parallel to each other similar to a railroad track in the weld patterns 32*a*, 32*b*, 32*c*, and 32*d*. The individual weld lines 34', 34" compress and join the fibers in the filtering structure such that they become mostly solidified into a nonporous solid-type bond.

The filtering structure 16 has a thickness A. As discussed in more detail below in reference to FIG. 6, the filtering structure 16 may include a plurality of layers of nonwoven fibrous material where at least one of the layers is a layer of filtering layer. These layers are welded together by the two parallel weld lines 34' and 34" that are spaced apart by a distance E of about (0.5 to 6)×A. More preferably, the parallel weld lines are spaced apart at (0.6 to 3)×A, and still more preferably are spaced apart at (0.7 to 1.5)×A. The layers of the nonwoven fibrous material in a region E between the two parallel lines 34', 34" has a thickness B that is less than the nominal, uncompressed thickness A of the plurality of layers of nonwoven material outside the parallel weld lines 34', 34" (measured away from the effect of weld line—i.e. away from the compressed area adjacent to the weld lines 34' and 34") but is greater than the thickness C of the filtering structure each of the welded lines 34', 34". The ratio of the thickness B of the filtering structure in the region E between the two parallel lines 34', 34" to the thickness A of the filtering structure outside the parallel weld lines 34', 34" is 0.3 to 0.9. More preferably, this ratio is 0.4 to 0.8, and still more preferably is 0.5 to 0.7. Typically, the spaced parallel weld lines are at least 3 cm long, and more typically greater than 4 cm long.

The parallel weld lines 34', 34" preferably are substantially continuous in areas of the mask body where improved structural integrity is desired. The weld lines may be created such that the various layers of the filtering structure are fused together to stiffen those layers in the weld line. Although the present invention has been illustrated using two parallel weld lines, three or more parallel weld lines may be used in a spaced apart relationship to create two or more substantially continuous regions or ribs 41 between the weld lines. The regions between each of the weld lines preferably are densified to assist in increasing the collapse resistance of the respirator. Increased densification in the rib 41 disposed between the first and second weld lines 34', 34" may further improve the beam stiffness and hence the collapse resistance of the mask body 12. The region between each of the weld lines may be densified such that the thickness of the plurality of layers of the nonwoven material between the weld lines is less than the thickness of those layers outside the weld lines as noted above. When parallel weld lines are used rather than a single weld line of similar width, ultrasonic welding may be carried out in a faster speed. Further, ultrasonic welding "flash" can be reduced when multiple weld lines are used versus a single weld line of the same total width. The thickness A of the layer, or plurality of layers, of nonwoven fibrous media that comprise the filtering structure 16 typically has a thickness of about 0.3 mm to 5 mm, more typically about 0.5 mm to 2.0 mm, and still more typically about 0.75 mm to 1.0. The thickness B of the region E between the first and second parallel weld lines 34', 34" typically is about 10 to 70 percent less than the thickness of the plurality of layers A, and more typically is about 20 to 40 percent less. The thickness B of the region between the first and second weld lines 34', 34" typically is about 0.18 mm to 2.7 mm, more typically about 0.32 mm to 1.8 mm, and still more typically about 0.45 mm to 0.9 mm. Each individual weld line 34' or 34" has a width dimension F that may be about 0.5 to 2 mm wide, more commonly about 0.75 to 1.5 mm wide. The total width D of the parallel weld lines typically is about 1.5 mm to 7.0 mm, more typically is about 2.0 mm to 5 mm, and still more typically is about 2.5 mm to 4.0 mm. As illustrated below in the Examples, experiments have been conducted which show improved beam strength of the weld when using a parallel weld line as opposed to a single flat weld line of a similar total width.

Weld lines are typically created using ultrasonic welding in either a "plunge" or "rotary" welding process. In general, a vibrating horn on the ultrasonic welder causes the filtering structure 16 to compress, melt and then solidify in a region that is against an anvil that contains the weld line patterns. This process can take a filtering structure 16 with thickness A and bond it together to a thickness C in the regions of contact between the horn and anvil. In plunge welding, the horn and anvil typically come into contact in an up and down motion with the filtering structure 16 in-between them, while in rotary welding the filtering structure 16 is continuously fed between the horn and anvil in a rotary fashion. Other means are possible to bond filtering structure 16 into weld lines, such as using heat and pressure with appropriate tooling.

Figure 5:
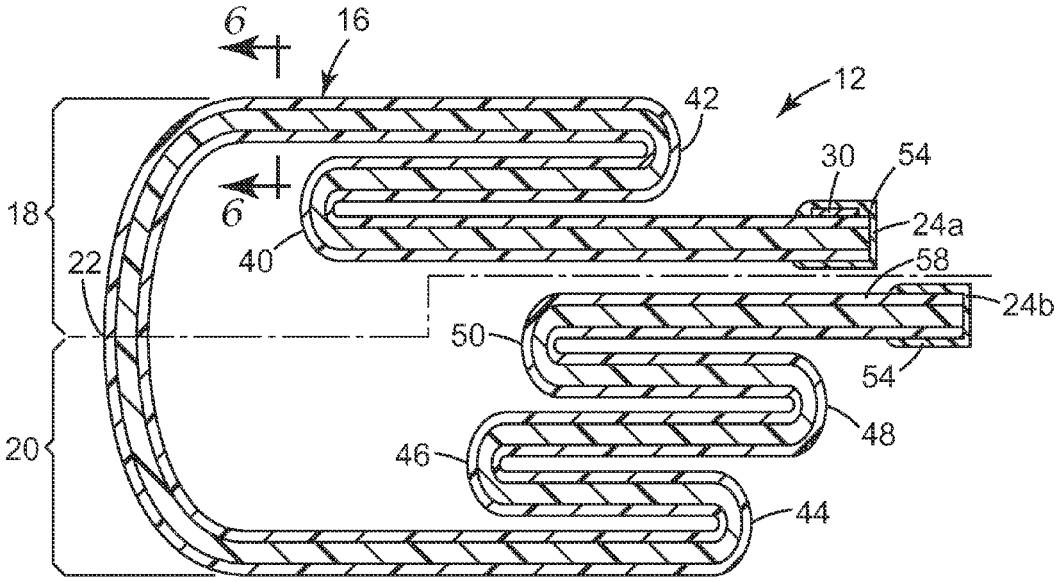
FIG. 5 is a cross-section of the respirator mask body 12 taken along lines 5-5 of FIG. 3.

FIG. 5 illustrates an example of a pleated configuration for the mask body 12. As shown, the mask body 12 includes pleat 22 already described with reference to FIGS. 1-3. The upper portion or panel 18 of the mask body 12 also includes pleats 40 and 42. The lower portion or panel 20 of the mask body 12 includes pleats 44, 46, 48, and 50. The mask body 12 also includes a perimeter web 54 that is secured to the mask body along its perimeter. The perimeter web 54 may be folded over the mask body at the perimeter 24*a*, 24*b*. The perimeter web 54 also may be an extension of the inner cover web 58 folded and secured around the edge of 24*a* and 24*b*. The nose clip 30 may be disposed on the upper portion 18 of the mask body, centrally adjacent to the perimeter 24*a* between the filtering structure 16 and the perimeter web 54. The nose clip 30 may be made from a pliable dead soft metal or plastic that is capable of being manually adapted by the wearer to fit the contour of the wearer's nose. The nose clip may be made from aluminum and may be linear as shown in FIG. 3, or it may take on other shapes when viewed from the top such as the m-shaped nose clip shown in U.S. Pat. No. 5,558,089 and Des. 412,573 to Castiglione.

Figure 6:
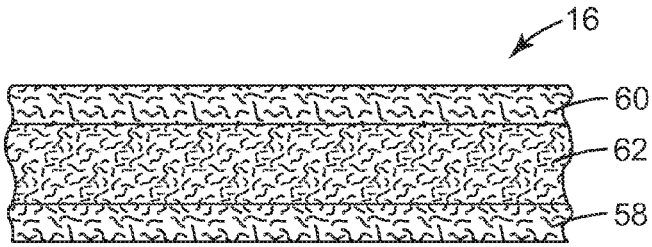
FIG. 6 is a cross-section of the filtering structure 16 taken along lines 6-6 of FIG. 5.

FIG. 6 illustrates that the filtering structure 16 may include one or more layers of nonwoven fibrous material such as an inner cover web 58, an outer cover web 60, and a filtration layer 62. The inner and outer cover webs 58 and 60 may be provided to protect the filtration layer 62 and to preclude fibers in the filtration layer 62 from coming loose and entering the mask interior. During respirator use, air passes sequentially through layers 60, 62, and 58 before entering the mask interior. The air that is disposed within the interior gas space of the mask may then be inhaled by the wearer. When a wearer exhales, the air passes in the opposite direction sequentially through layers 58, 62, and 60. Alternatively, an exhalation valve (not shown) may be provided on the mask body to allow exhaled air to be rapidly purged from the interior gas space to enter the exterior gas space without passing through filtering structure 16. Typically, the cover webs 58 and 60 are made from a selection of nonwoven materials that provide a comfortable feel, particularly on the side of the filtering structure that makes contact with the wearer's face. The construction of various filter layers and cover webs that may be used in conjunction with the filtering structure are described below in more detail. To improve wearer fit and comfort, an elastomeric face seal can be secured to the perimeter of the filtering structure 16. Such a face seal may extend radially inward to contact the wearer's face when the respirator is being donned. Examples of face seals are described in U.S. Pat. No. 6,568,392 to Bostock et al., U.S. Pat. No. 5,617,849 to Springett et al., and U.S. Pat. No. 4,600,002 to Maryyanek et al., and in Canadian Patent 1,296,487 to Yard. The filtering structure also may have a structural netting or mesh juxtaposed against at least one or more of the layers 58, 60, or 62, typically against the outer surface of the outer cover web 60. The use of such a mesh is described in U.S. patent application Ser. No. 12/338,091, filed Dec. 18, 2008, entitled Expandable Face Mask with Reinforcing Netting.

The mask body that is used in connection with the present invention may take on a variety of different shapes and configurations. Although a filtering structure has been illustrated with multiple layers that include a filtration layer and two cover webs, the filtering structure may simply comprise a combination of filtration layers or a combination of filter layer(s) and cover web(s). For example, a pre-filter may be disposed upstream to a more refined and selective downstream filtration layer. Additionally, sorptive materials such as activated carbon may be disposed between the fibers and/or various layers that comprise the filtering structure. Further, separate particulate filtration layers may be used in conjunction with sorptive layers to provide filtration for both particulates and vapors. The filtering structure may include one or more stiffening layers that assist in providing a cup-shaped configuration. The filtering structure also could have one or more horizontal and/or vertical lines of demarcation that contribute to its structural integrity. Using the first and second flanges in accordance with the present invention, however, may make unnecessary the need for such stiffening layers and lines of demarcation.

The filtering structure that is used in a mask body of the invention can be of a particle capture or gas and vapor type filter. The filtering structure also may be a barrier layer that prevents the transfer of liquid from one side of the filter layer to another to prevent, for instance, liquid aerosols or liquid splashes (e.g. blood) from penetrating the filter layer. Multiple layers of similar or dissimilar filter media may be used to construct the filtering structure of the invention as the application requires. Filters that may be beneficially employed in a layered mask body of the invention are generally low in pressure drop (for example, less than about 195 to 295 Pascals at a face velocity of 13.8 centimeters per second) to minimize the breathing work of the mask wearer. Filtration layers additionally are flexible and have sufficient shear strength so that they generally retain their structure under the expected use conditions. Examples of particle capture filters include one or more webs of fine inorganic fibers (such as fiberglass) or polymeric synthetic fibers. Synthetic fiber webs may include electret-charged polymeric microfibers that are produced from processes such as meltblowing. Polyolefin microfibers formed from polypropylene that has been electrically charged provide particular utility for particulate capture applications. An alternate filter layer may comprise a sorbent component for removing hazardous or odorous gases from the breathing air. Sorbents may include powders or granules that are bound in a filter layer by adhesives, binders, or fibrous structures—see U.S. Pat. No. 6,334,671 to Springett et al. and U.S. Pat. No. 3,971,373 to Braun. A sorbent layer can be formed by coating a substrate, such as fibrous or reticulated foam, to form a thin coherent layer. Sorbent materials may include activated carbons that are chemically treated or not, porous alumna-silica catalyst substrates, and alumna particles. An example of a sorptive filtration structure that may be conformed into various configurations is described in U.S. Pat. No. 6,391,429 to Senkus et al.

The filtration layer is typically chosen to achieve a desired filtering effect. The filtration layer generally will remove a high percentage of particles and/or or other contaminants from the gaseous stream that passes through it. For fibrous filter layers, the fibers selected depend upon the kind of substance to be filtered and, typically, are chosen so that they do not become bonded together during the molding operation. As indicated, the filtration layer may come in a variety of shapes and forms and typically has a thickness of about 0.2 millimeters (mm) to 1 centimeter (cm), more typically about 0.3 mm to 0.5 cm, and it could be a generally planar web or it could be corrugated to provide an expanded surface area—see, for example, U.S. Pat. Nos. 5,804,295 and 5,656,368 to Braun et al. The filtration layer also may include multiple filtration layers joined together by an adhesive or any other means. Essentially any suitable material that is known (or later developed) for forming a filtering layer may be used as the filtering material. Webs of melt-blown fibers, such as those taught in Wente, Van A., *Superfine Thermoplastic*

*Fibers,* 48 Indus. Engn. Chem., 1342 et seq. (1956), especially when in a persistent electrically charged (electret) form are especially useful (see, for example, U.S. Pat. No. 4,215,682 to Kubik et al.). These melt-blown fibers may be microfibers that have an effective fiber diameter less than about 20 micrometers (μm) (referred to as BMF for "blown microfiber"), typically about 1 to 12 μm. Effective fiber diameter may be determined according to Davies, C. N., *The Separation Of Airborne Dust Particles*, Institution Of Mechanical Engineers, London, Proceedings 1B, 1952. Particularly preferred are BMF webs that contain fibers formed from polypropylene, poly(4-methyl-1-pentene), and combinations thereof. Electrically charged fibrillated-film fibers as taught in van Turnhout, U.S. Pat. Re. 31,285, also may be suitable, as well as rosin-wool fibrous webs and webs of glass fibers or solution-blown, or electrostatically sprayed fibers, especially in microfilm form. Electric charge can be imparted to the fibers by contacting the fibers with water as disclosed in U.S. Pat. No. 6,824,718 to Eitzman et al., U.S. Pat. No. 6,783,574 to Angadjivand et al., U.S. Pat. No. 6,743,464 to Insley et al., U.S. Pat. Nos. 6,454,986 and 6,406,657 to Eitzman et al., and U.S. Pat. Nos. 6,375,886 and 5,496,507 to Angadjivand et al. Electric charge also may be imparted to the fibers by corona charging as disclosed in U.S. Pat. No. 4,588,537 to Klasse et al. or by tribocharging as disclosed in U.S. Pat. No. 4,798,850 to Brown. Also, additives can be included in the fibers to enhance the filtration performance of webs produced through the hydro-charging process (see U.S. Pat. No. 5,908,598 to Rousseau et al.). Fluorine atoms, in particular, can be disposed at the surface of the fibers in the filter layer to improve filtration performance in an oily mist environment—see U.S. Pat. Nos. 6,398,847 B1, 6,397,458 B1, and 6,409,806 B1 to Jones et al. Typical basis weights for electret BMF filtration layers are about 10 to 100 grams per square meter. When electrically charged according to techniques described in, for example, the '507 Angadjivand et al. patent, and when including fluorine atoms as mentioned in the Jones et al. patents, the basis weight may be about 20 to 40 g/m$^2$ and about 10 to 30 g/m$^2$, respectively.

An inner cover web can be used to provide a smooth surface for contacting the wearer's face, and an outer cover web can be used to entrap loose fibers in the mask body or for aesthetic reasons. The cover web typically does not provide any substantial filtering benefits to the filtering structure, although it can act as a pre-filter when disposed on the exterior (or upstream to) the filtration layer. To obtain a suitable degree of comfort, an inner cover web preferably has a comparatively low basis weight and is formed from comparatively fine fibers. More particularly, the cover web may be fashioned to have a basis weight of about 5 to 50 g/m$^2$ (typically 10 to 30 g/m$^2$), and the fibers may be less than 3.5 denier (typically less than 2 denier, and more typically less than 1 denier but greater than 0.1). Fibers used in the cover web often have an average fiber diameter of about 5 to 24 micrometers, typically of about 7 to 18 micrometers, and more typically of about 8 to 12 micrometers. The cover web material may have a degree of elasticity (typically, but not necessarily, 100 to 200% at break) and may be plastically deformable.

Suitable materials for the cover web may be blown microfiber (BMF) materials, particularly polyolefin BMF materials, for example polypropylene BMF materials (including polypropylene blends and also blends of polypropylene and polyethylene). A suitable process for producing BMF materials for a cover web is described in U.S. Pat. No. 4,013,816 to Sabee et al. The web may be formed by collecting the fibers on a smooth surface, typically a smooth-surfaced drum or a rotating collector—see U.S. Pat. No. 6,492,286 to Berrigan et al. Spun-bond fibers also may be used.

A typical cover web may be made from polypropylene or a polypropylene/polyolefin blend that contains 50 weight percent or more polypropylene. These materials have been found to offer high degrees of softness and comfort to the wearer and also, when the filter material is a polypropylene BMF material, to remain secured to the filter material without requiring an adhesive between the layers. Polyolefin materials that are suitable for use in a cover web may include, for example, a single polypropylene, blends of two polypropylenes, and blends of polypropylene and polyethylene, blends of polypropylene and poly(4-methyl-1-pentene), and/or blends of polypropylene and polybutylene. One example of a fiber for the cover web is a polypropylene BMF made from the polypropylene resin "Escorene 3505G" from Exxon Corporation, providing a basis weight of about 25 g/m$^2$ and having a fiber denier in the range 0.2 to 3.1 (with an average, measured over 100 fibers of about 0.8). Another suitable fiber is a polypropylene/polyethylene BMF (produced from a mixture comprising 85 percent of the resin "Escorene 3505G" and 15 percent of the ethylene/alpha-olefin copolymer "Exact 4023" also from Exxon Corporation) providing a basis weight of about 25 g/m$^2$ and having an average fiber denier of about 0.8. Suitable spunbond materials are available, under the trade designations "Corosoft Plus 20", "Corosoft Classic 20" and "Corovin PP-S-14", from Corovin GmbH of Peine, Germany, and a carded polypropylene/viscose material available, under the trade designation "370/15", from J. W. Suominen OY of Nakila, Finland.

Cover webs that are used in the invention preferably have very few fibers protruding from the web surface after processing and therefore have a smooth outer surface. Examples of cover webs that may be used in the present invention are disclosed, for example, in U.S. Pat. No. 6,041,782 to Angadjivand, U.S. Pat. No. 6,123,077 to Bostock et al., and WO 96/28216A to Bostock et al.

The strap(s) that are used in the harness may be made from a variety of materials, such as thermoset rubbers, thermoplastic elastomers, braided or knitted yarn/rubber combinations, inelastic braided components, and the like. The strap(s) may be made from an elastic material such as an elastic braided material. The strap preferably can be expanded to greater than twice its total length and be returned to its relaxed state. The strap also could possibly be increased to three or four times its relaxed state length and can be returned to its original condition without any damage thereto when the tensile forces are removed. The elastic limit thus is preferably not less than two, three, or four times the length of the strap when in its relaxed state. Typically, the strap(s) are about 20 to 30 cm long, 3 to 10 mm wide, and about 0.9 to 1.5 mm thick. The strap(s) may extend from the first tab to the second tab as a continuous strap or the strap may have a plurality of parts, which can be joined together by further fasteners or buckles. For example, the strap may have first and second parts that are joined together by a fastener that can be quickly uncoupled by the wearer when removing the mask body from the face. An example of a strap that may be used in connection with the present invention is shown in U.S. Pat. No. 6,332,465 to Xue et al. Examples of fastening or clasping mechanism that may be used to joint one or more parts of the strap together is shown, for example, in the following U.S. Pat. No. 6,062,221 to Brostrom et al., U.S. Pat. No. 5,237,986 to Seppala, and EP 1,495,785A1 to Chien.

As indicated, an exhalation valve may be attached to the mask body to facilitate purging exhaled air from the interior gas space. The use of an exhalation valve may improve wearer comfort by rapidly removing the warm moist exhaled air from the mask interior. See, for example, U.S. Pat. Nos. 7,188,622, 7,028,689, and 7,013,895 to Martin et al.; U.S. Pat. Nos. 7,428,903, 7,311,104, 7,117,868, 6,854,463, 6,843,248, and 5,325,892 to Japuntich et al.; U.S. Pat. No. 6,883,518 to Mittelstadt et al.; and RE 37,974 to Bowers. Essentially any exhalation valve that provides a suitable pressure drop and that can be properly secured to the mask body may be used in connection with the present invention to rapidly deliver exhaled air from the interior gas space to the exterior gas space.

EXAMPLES

The invention improves the collapse resistance of flat-fold filtering facepiece respirators by increasing the stiffness of portions of the respirators, for example, 32*a*, 32*b*, 32*c* and 32*d* in FIG. 2. This is accomplished by using heat to compress and bond together the layers of the filtering structure 16 in FIG. 1. The Taber Stiffness Tester (Taber Industries, North Tonawanda, N.Y., USA) can be used to measure the stiffness of a variety of materials, including nonwoven materials which are often used in the construction of filtering facepiece respirators.

The Taber Stiffness Tester measures the stiffness of a strip of material by determining the amount of torque required to deflect the sample by a specified amount, typically 15°. The result of a test conducted with the Taber Stiffness Tester is reported in Taber Stiffness Units. One Taber Stiffness Unit is defined as the stiffness required for 1 cm long sample to be deflected 15° when a torque of 1 gm-cm is applied to one end of the sample. By placing the tester in different configurations, the Taber Stiffness Tester can measure a range of stiffness from less than 1 Taber Stiffness Unit up to 10,000 Taber Stiffness Units.

Manufacturing equipment utilizing a rotary ultrasonic thermal bonding process was used to create flat-fold filtering facepiece respirators similar to 10 in FIGS. 1-3. Ten respirators each were made of Example 1, Comparative Sample 1CA, and Comparative Sample 1 CB. Example 1 respirators were made with weld lines 33 in FIG. 2 comprised of two parallel 0.5 mm wide lines separated by an unwelded gap of 2.0 mm. The cross-section of this dual weld line pattern had the appearance shown in FIG. 4 with parallel weld lines 34' and 34". Comparative Sample 1CA respirators were made without weld patterns 32*a*, 32*b*, 32*c* and 32*d* shown in FIG. 2, and comparative Sample 1CB samples were made with weld lines 33 in FIG. 2 comprised of a single 3.0 mm wide line.

In Example 1 and Comparative Samples 1CA and 1CB, the filtering structure 16 shown in FIG. 6 was comprised of a filter layer 62 sandwiched between two spunbond coverwebs 58 and 60. The filter layer was comprised of a single layer of polypropylene electret BMF web having a basis weight of 59 grams per square meter (g/m$^2$) and an effective fiber diameter (EFD) of 7.5 micrometers (μm). Both coverweb layers were identical polypropylene spunbond webs from Shangdong Kangjie Nonwovens Co. Ltd. (Jinan, China) having a basis weight of 34 g/m$^2$.

Ten respirators each of Example 2 and Comparative Samples 2CA and 2CB were made with the same manufacturing process used to create Example 1 and Comparative Samples 1CA and 1CB. The filter layer 62 in Example 2 and Comparative samples 2CA and 2CB was comprised of two layers of the same electret polypropylene BMF used to make Example 1 and the corresponding comparative samples. The spunbond coverwebs 58 and 60 used to make Example 2 and Comparative Samples 2CA and 2CB were the same coverwebs used to Example 1 and the corresponding comparative samples.

Samples of the filtering structure of the respirators were collected for stiffness testing by cutting a 32 mm long by 6 mm wide strip of the material containing one of the angled sides of triangular weld patterns 32*a*, 32*b*, 32*c* or 32*d*. The strip was cut from each respirator so that the weld pattern was centered in the strip and was parallel to the long side of the strip. The edges of the layers in each sample strip were separated to remove any thermal bond between the layers caused by cutting the samples with scissors. Before stiffness testing, dimensions A, B, C, D, E, and F shown in FIG. 4 were determined for one sample strip of each type using a digital micrometer. The measurements are shown in Table 1. The calculated quantities E÷A, B÷A and D÷A are also shown in Table 1. Each sample strip was evaluated with a Model 150E Taber Stiffness Tester (Taber Industries, North Tonawanda, N.Y., USA) using the SR attachment and the 10 unit compensator in the 0 to 1 Taber Stiffness Unit range. The stiffness test results for the ten sample strips of each type, i.e. Examples 1 and 2 and Comparative Samples 1CA, 1CB, 2CA and 2CB, were the averaged and are shown in FIG. 7.

Figure 7:
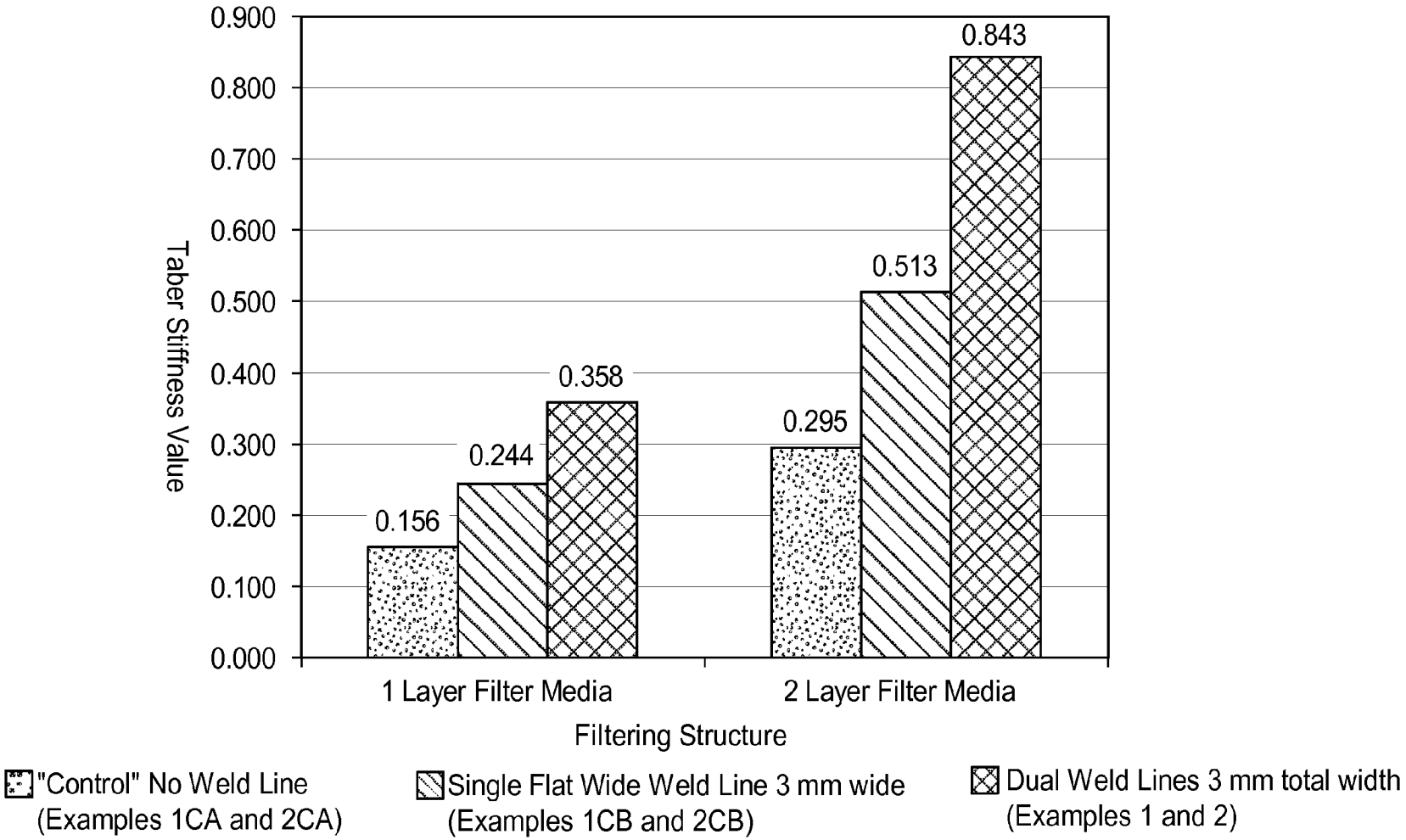
FIG. 7 is a bar graph of Taber Stiffness Measurements for unwelded and single and dual line weld patterns carried out using a rotary welder.

The results of the Taber Stiffness Test shown in FIG. 7 demonstrate that the invention, as implemented in Examples 1 and 2, increases the stiffness of a portion of the filtering structure 16 when compared to the corresponding comparative samples (based on number of BMF layers). This increase in stiffness of the dual weld line over a single wide weld line coupled with an appropriate pattern, such as the triangular patterns in FIG. 2 is expected to improve the collapse resistance of examples of the invention over the corresponding comparative samples.

Through inspection of the calculated values in Table 1, E÷A, B÷A and D÷A, it can be seen the dual weld line pattern can be characterized by the calculated values. The value E÷A corresponds to the ratio of the spacing between the dual weld lines and the thickness of the unwelded filtering structure. The value B÷A is the ratio of the height of the rib between the dual weld lines and the thickness of the unwelded filtering structure. The value D÷A is the ratio of width of the weld pattern to the thickness of the unwelded filtering structure.

TABLE 1

Examples And Comparative Samples Made With Rotary Ultrasonic Thermal Bonding Process

| Sample | Number of BMF layers | Weld Pattern | Dimensions (mm) per FIG. 4 | | | | | | Calculated Values | | |
|---|---|---|---|---|---|---|---|---|---|---|---|
| | | | A | B | C | D | E | F | E ÷ A | B ÷ A | D ÷ A |
| Example 1 | 1 | Dual weld line 3 mm wide | 1.61 | 0.66 | 0.11 | 3.0 | 1.4 | 0.8 | 0.9 | 0.41 | 1.9 |

TABLE 1-continued

Examples And Comparative Samples Made With Rotary Ultrasonic Thermal Bonding Process

| Sample | Number of BMF layers | Weld Pattern | Dimensions (mm) per FIG. 4 A | B | C | D | E | F | Calculated Values E ÷ A | B ÷ A | D ÷ A |
|---|---|---|---|---|---|---|---|---|---|---|---|
| Comparative Sample 1CA | 1 | None | 1.61 | — | — | — | — | — | — | — | — |
| Comparative Sample 1CB | 1 | Single 3 mm wide line | 1.61 | 0.19 | 0.19 | 3.0 | 0.0 | — | 0.0 | 0.12 | 1.9 |
| Example 2 | 2 | Dual weld line 3 mm wide | 2.77 | 1.03 | 0.26 | 3.0 | 1.4 | 0.8 | 0.5 | 0.37 | 1.1 |
| Comparative Sample 2CA | 2 | None | 2.77 | — | — | — | — | — | — | — | — |
| Comparative Sample 2CB | 2 | Single 3 mm wide line | 2.77 | 0.24 | 0.24 | 3.0 | 0.0 | — | 0.0 | 0.09 | 1.1 |

(—) indicates that measurement is not available due to lack of applicable features on sample.

Ultrasonic plunge thermal bonding also can be used to form patterns of weld lines on filtering facepiece respirators. A series of three patent examples, Example 3, 4 and 5, were created with ultrasonic plunge thermal bonding, in addition to corresponding comparative examples. In these examples and the comparative samples, patterns of weld lines corresponding to the triangular patterns 32*a*, 32*b*, 32*c* and 32*d* shown in FIG. 2 were formed on sheets of filter structure laminate 16 using a Branson 2000X series plunge welding system (Danbury, Conn., USA). A dual weld line pattern similar to that used for Examples 1 and 2 was formed on ten sheets each of filtering structure laminates with 1, 2 or 3 layers of polypropylene electret BMF in the filter layer 62. Example 3 contained 1 layer of polypropylene electret BMF, Example 4 contained 2 layers of BMF and Example 5 contained 3 layers of BMF. The polypropylene electret BMF, used for Examples 3, 4 and 5 was the same BMF described in Examples 1 and 2. In all of the filtering structure laminates, the filter layer 62 was sandwiched between two spunbond coverwebs, 58 and 60, which was the same spunbond coverweb used in Examples 1 and 2.

Ten laminates sheets each of Comparative Samples 3CA, 3CB, and 3CC were created with the same filtering structure laminate used to create Example 3. No welding pattern was formed on the laminate sheets of Comparative Sample 3CA. The same ultrasonic plunge welding system used to make Examples 3, 4, and 5 was used to create the triangular patterns 32*a*, 32*b*, 32*c*, and 32*d* shown in FIG. 2 with a single 0.5 mm wide weld line on the laminate sheets of Comparative Sample 3CB. Similarly, in Example 3CC the ultrasonic welding system was used to create triangular patterns on ten laminate sheets with a single 3 mm wide weld line.

Sets of ten laminate sheets each were created of Comparative Samples 4CA, 4CB, and 4CC using the sample procedure used to create Comparative Samples 3CA, 3CB, and 3CC, respectively. The only difference between the two sets of comparative samples was that the second set, 4CA, 4CB and 4CC were made with filtering structure laminate containing two layers of the polypropylene electrets filter web. The procedure was repeated for Comparative Samples 5CA, 5CB and 5CC, except the filtering structure laminate used contained 3 layers of the polypropylene electrets filter web.

Figure 8:
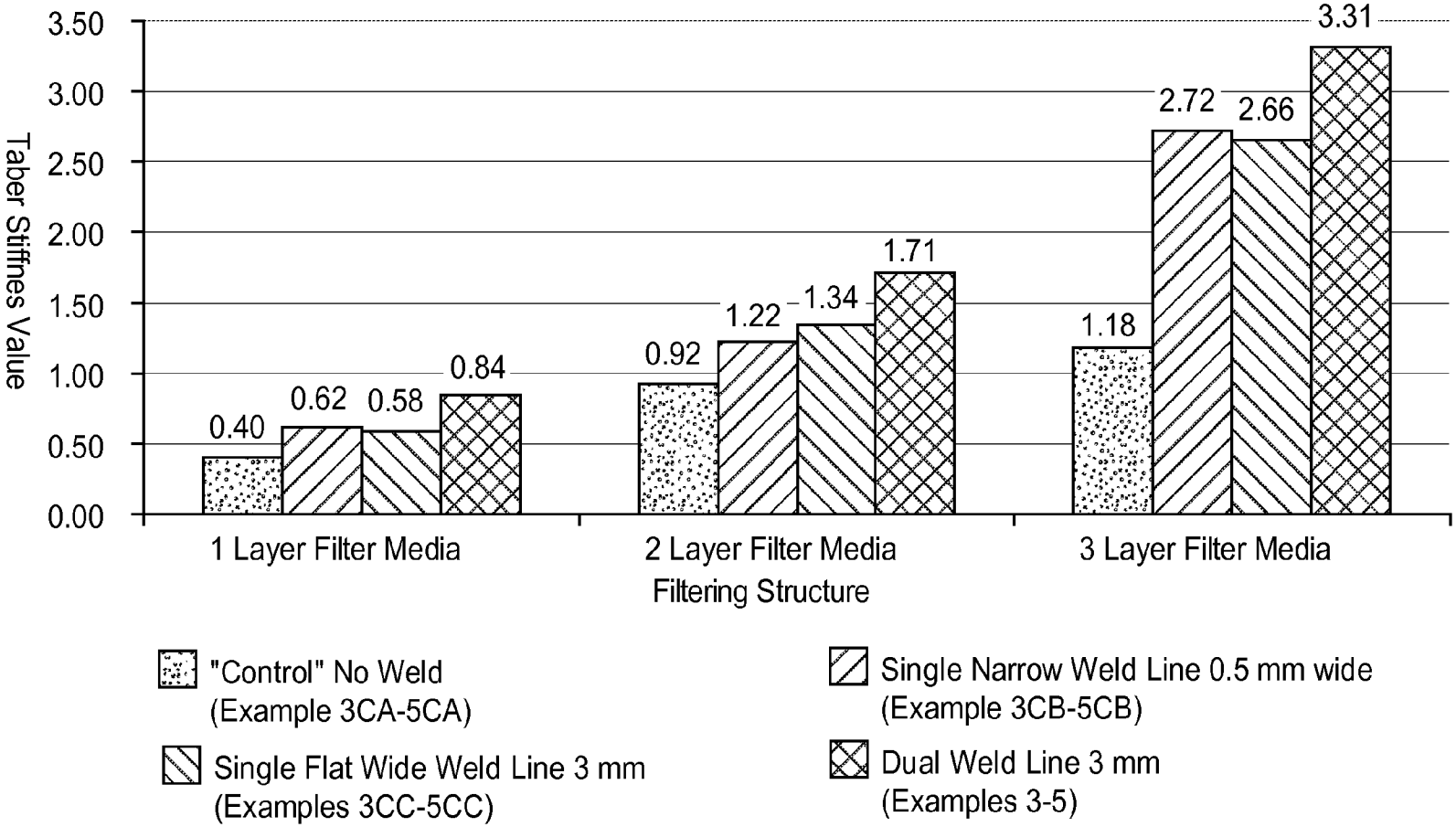
FIG. 8 is a bar graph of Taber Stiffness Measurements for unwelded and single and dual line weld patterns carried out using a plunge welder.

Samples of the filtering structure laminate sheets were collected for stiffness testing by cutting a 32 mm long by 6 mm wide strip of the material containing one of the angled sides of triangular weld patterns 32*a*, 32*b*, 32*c* or 32*d*. The strip was cut from each laminate sheet so that the weld pattern was centered in the strip and was parallel to the long side of the strip. The edges of the layers in each sample strip were separated to remove any thermal bond between the layers caused by cutting the samples with scissors. Before stiffness testing, dimensions A, B, C, D, E, and F shown in FIG. 4 were determined for one sample strip of each type using a digital micrometer. The measurements are shown in Table 2. The calculated quantities E÷A, B÷A and D÷A are also shown in Table 2. Each sample strip was evaluated with a Model 150E Taber Stiffness Tester (Taber Industries, North Tonawanda, N.Y., USA) using the sample clamps in the inverted position and with the 10 unit compensator in the 0 to 10 Taber Stiffness Unit range. The stiffness test results for the ten sample strips of each type, i.e. Examples 3, 4 and 5 and Comparative Samples 3CA through 5CC, were the averaged and are shown in FIG. 8.

TABLE 2

Examples And Comparative Samples Made With A Plunge Ultrasonic Thermal Bonding Process

| Sample | Number of filter layers | Weld Pattern | Dimensions (mm) per FIG. 4 A | B | C | D | E | F | Calculated Values E ÷ A | B ÷ A | D ÷ A |
|---|---|---|---|---|---|---|---|---|---|---|---|
| Example 3 | 1 | Dual weld line 3 mm wide | 1.61 | 0.83 | 0.22 | 3.0 | 2.0 | 0.5 | 1.2 | 0.52 | 1.9 |

TABLE 2-continued

Examples And Comparative Samples Made With A Plunge Ultrasonic Thermal Bonding Process

| Sample | Number of filter layers | Weld Pattern | Dimensions (mm) per FIG. 4 | | | | | | Calculated Values | | |
|---|---|---|---|---|---|---|---|---|---|---|---|
| | | | A | B | C | D | E | F | E ÷ A | B ÷ A | D ÷ A |
| Comparative Sample 3CA | 1 | None | — | — | — | — | — | — | — | — | — |
| Comparative Sample 3CB | 1 | Single 0.5 mm wide line | 1.61 | 0.14 | 0.14 | 0.5 | 0.0 | — | 0.0 | 0.09 | 0.3 |
| Comparative Sample 3CC | 1 | Single 3.0 mm wide line | 1.61 | 0.15 | 0.15 | 3.0 | 0.0 | — | 0.0 | 0.09 | 1.9 |
| Example 4 | 2 | Dual weld line 3 mm wide | 2.77 | 0.99 | 0.33 | 3.0 | 2.0 | 0.5 | 0.7 | 0.36 | 1.1 |
| Comparative Sample 4CA | 2 | None | — | — | — | — | — | — | — | — | — |
| Comparative Sample 4CB | 2 | Single 0.5 mm wide line | 2.77 | 0.26 | 0.26 | 0.5 | 0.0 | — | 0.0 | 0.09 | 0.2 |
| Comparative Sample 4CC | 2 | Single 3.0 mm wide line | 2.77 | 0.25 | 0.25 | 3.0 | 0.0 | — | 0.0 | 0.09 | 1.1 |
| Example 5 | 3 | Dual weld line 3 mm wide | 2.97 | 1.08 | 0.20 | 3.0 | 2.0 | 0.5 | 0.7 | 0.36 | 1.0 |
| Comparative Sample 5CA | 3 | None | — | — | — | — | — | — | — | — | — |
| Comparative Sample 5CB | 3 | Single 0.5 mm wide line | 2.97 | 0.17 | 0.17 | 0.5 | 0.0 | — | 0.0 | 0.06 | 0.2 |
| Comparative Sample 5CC | 3 | Single 3.0 mm wide line | 2.97 | 0.36 | 0.36 | 3.0 | 0.0 | — | 0.0 | 0.12 | 1.0 |

(—) indicates that measurement is not available due to lack of applicable features on sample.

The results of the Taber Stiffness Test shown in FIG. 8 demonstrate that the invention, as implemented in Examples 3, 4, and 5, increases the stiffness of a portion of the filtering structure 16 when compared to the corresponding comparative samples. This increase in stiffness of the dual weld line over a single wide weld line is expected to improve the collapse resistance of examples of the invention over the corresponding comparative samples. Through inspection of the calculated values in Table 2, E÷A, B÷A and D÷A, it can be seen the dual weld line pattern can be characterized by the calculated values.

This invention may take on various modifications and alterations without departing from its spirit and scope. Accordingly, this invention is not limited to the above-described but is to be controlled by the limitations set forth in the following claims and any equivalents thereof.

This invention also may be suitably practiced in the absence of any element not specifically disclosed herein.

All patents and patent applications cited above, including those in the Background section, are incorporated by reference into this document in total. To the extent there is a conflict or discrepancy between the disclosure in such incorporated document and the above specification, the above specification will control.

What is claimed is:

1. A filtering face-piece respirator that comprises:

(a) a harness; and (b) a mask body that is joined to the harness, the mask body comprising a filtering structure that has a thickness A and that has two parallel weld lines disposed therein which are spaced 0.5 to 6 times A, wherein the filtering structure in a region between the two parallel weld lines has a thickness that is less than the thickness of the filtering structure outside the two parallel weld lines but is greater than the thickness of the filtering structure in each of the parallel weld lines.

2. The respirator of claim 1, wherein the two parallel weld lines are spaced 0.6 to 3 times A.

3. The respirator of claim 2, wherein the two parallel weld lines are spaced 0.7 to 1.5 times A.

4. The respirator of claim 1, wherein the ratio of the thickness of the filtering structure in a region between the two parallel weld lines to the thickness of the filtering structure outside the parallel weld lines is 0.3 to 0.9.

5. The respirator of claim 1, wherein the ratio of the thickness of the filtering structure in a region between the two parallel weld lines to the thickness of the filtering structure outside the parallel weld lines is 0.4 to 0.8.

6. The respirator of claim 1, wherein the ratio of the thickness of the filtering structure in a region between the two parallel weld lines to the thickness of the filtering structure outside the parallel weld lines is 0.5 to 0.7.

7. The respirator of claim 1, wherein the thickness of the filtering structure outside the two parallel weld lines is about 0.3 to 5 mm.

8. The respirator of claim 7, wherein the thickness of a region B between the parallel weld lines is about 10 to 70% less than the thickness A.

9. The respirator of claim 1, wherein each of the weld lines has a width of about 0.5 to 2 mm.

10. The respirator of claim 9, wherein the total width of the parallel weld lines is 1.5 to 7 mm.

11. The respirator of claim 9, wherein the total width of the parallel weld lines is 2 to 5 mm.

12. The respirator of claim 1, wherein the spaced parallel weld lines are at least 3 cm long.

13. The respirator of claim 1, wherein the spaced parallel weld lines are at least 4 cm long.

14. The respirator of claim 1, further comprising a third parallel weld line that is spaced from one of the two parallel weld lines at 0.5 to 6 times A.

15. A respirator that comprises:

(a) a harness;

(b) a mask body that is joined to the harness, the mask body comprising a filtering structure that comprises a plurality of layers of nonwoven fibrous material, the plurality of layers of nonwoven fibrous material having a thickness A and being welded together by at least two parallel weld lines that are spaced 0.5 to 6 times A, wherein a rib is disposed between the parallel weld lines, the rib having a thickness that is less than A.

16. The respirator of claim 15, wherein the rib is 10 to 70% less thick than A, and wherein the parallel weld lines are spaced at 0.6 to 3 times A.

* * * * *